United States Patent [19]

Olszewski et al.

[11] 3,968,321

[45] July 6, 1976

[54] OFFSET "O" INTERNAL SHIELD DESIGN FOR PCM TELEPHONE CABLES

[75] Inventors: Jerzy Adam Olszewski, Edison, N.J.; Anthony P. Gabriel, Staten Island, N.Y.

[73] Assignee: General Cable Corporation, New York, N.Y.

[22] Filed: Oct. 3, 1973

[21] Appl. No.: 403,016

[52] U.S. Cl. ..... 174/36; 174/105 R; 174/107; 174/117 FF

[51] Int. Cl.[2] ..... H01B 11/04

[58] Field of Search ..... 174/36, 105 R, 105 B, 174/107, 117 F, 117 FF, 117 R; 156/47, 51, 52, 53, 54, 160, 163, 164, 204, 213

[56] References Cited

UNITED STATES PATENTS 3,803,340 4/1974 Jachimowicz et al. ..... 174/105 B 3,819,443 6/1974 Simons et al. ..... 174/36

*Primary Examiner*—Arthur T. Grimley

*Attorney, Agent, or Firm*—Sandoe, Hopgood & Calimafde

[57] ABSTRACT

The telephone communication cable of this specification has a metal shield formed by bending a sheet of metal at one or both edges so that the portions of the sheet that are folded over one another form a shield of double thickness and the shield has one or both of its edges formed by a continuous extent of folded metal instead of a square edge or fluted edge with a burr along the side of the edge toward which the slitting instrument advanced to make the cut. Air spaces are prevented by filling any clearance between the folded areas of the shield with adhesive. The shield is applied as a D-Screen with the edges off the original strip on the curved part of the D-Screen and away from the group of pairs that are shielded by the D-Screen.

14 Claims, 6 Drawing Figures

OFFSET "O" INTERNAL SHIELD DESIGN FOR PCM TELEPHONE CABLES

BACKGROUND AND SUMMARY OF THE INVENTION

In the telephone communications cable there is always a degree of interference between circuits due to the proximity of paired circuits. The induction of "disturbing" pair currents into the "disturbed" pair, i.e. "crosstalk", is a primary form of interference. Two currents are carried by what has been termed the "disturbed" pair; the transmission information current and the unwanted current induced in pairs in close proximity. This secondary current superimposed on the transmitted signal results in unreliable signal results as well as a reduction in signal clarity.

With the advent of pulse code modulation, (PCM), in the field of transmission techniques on balanced pairs, (potential symmetrical to ground), it became necessary to divide the number of pairs in the cable core into two groups of equal number, one group carrying signals in one direction and the other, in the opposite direction, or by the use of two separate cables. This latter technique, though sound from the engineering level, is at times more expensive, especially if pair sizes (pair counts) of cables are small.

Since present day cables are made of prestranded units, the conventional method of stranding first one half of the cable pairs, applying shield and then stranding over it the second half of the cable pairs was not practical, (i.e. the prestranded units could not be assembled in symmetrical concentric fashion). The earlier solution consisted of an "S" or "Z" shaped internal shield. This was followed by the concept of the "D" shaped internal shield, which resulted in improved shielding efficiency, with respect to the earlier "S" or "Z" concepts, and the minimum requirement imposed by the PCM transmission systems known as T-1 carrier.

Since present day internal shields are closely coupled capacitively to the overall shield, it can be assumed to be at ground potential, though no direct ground path exists. This results in the need for high voltage separation of the working circuits and the internal shield. One type of internal shield is a laminated tape consisting of a sheet of aluminum bonded with a pressure sensitive adhesive to a sheet of polyester on each face, with an overlap of polyester on each edge of the aluminum. These overlapping edges of polyester are bonded to each other with adhesive. This type of internal shield has two distinct disadvantages. One is that there is an air gap at each edge of the aluminum where the polyester coatings taper toward one another beyond the edge of the aluminum. This separation of the polyester strips at the edges of the aluminum is equal to the thickness of the aluminum.

The gap formed between the edge of the aluminum and the location where the polyester strips come together provides a space for water ingress which will corrode the internal aluminum shield and it makes it difficult to stop a gas flow along the conductor when pressure dams are constructed. These gaps also allow for the influx of the cable filling compound, which has a tendency to delaminate this variety of internal shield tape.

The present invention provides an improved shield which is formed by bending the edge portion on each side of a strip back on itself to provide 180° curves along the edges instead of the abrupt corner which is obtained with commonly used aluminum strips. The improved shield can be made by folding a metal strip along its center region but this leaves the opposite edge with a square configuration; so the folding of both edges is a superior construction. The strip can be folded so that the edges are folded over on the same side of the strip and at locations which bring the edges into abutment, or substantial abutment after folding. When made into a D-Screen, the edges of the original strip are located away from the shielded group of pairs.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENTS

Figure 1:
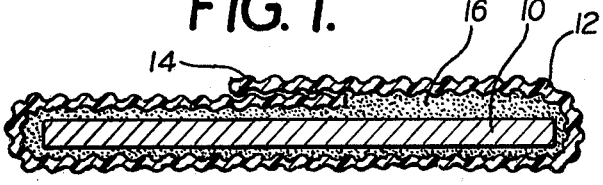
FIGS. 1 and 2 are greatly enlarged, sectional views showing the shield constructions of the prior art.

FIG. 1 shows one of the earliest types of internal shield of the prior art. It includes an aluminum strip 10 which is wrapped with a polyester wrapping 12 having a lap seam 14. The confronting faces of the aluminum and polyester were coated with a polyethylene-petroleum jelly (PE/PJ), commonly used in filled cables today. This polyethylene-petroleum jelly is indicated in FIG. 1 by the reference character 16.

The tape shown in FIG. 1 had a high manufacturing cost and also presented manufacturing problems, such as slippage between the aluminum and the polyester. These difficulties lead to the use of a laminated shield, such as shown in FIG. 2.

Figure 2:
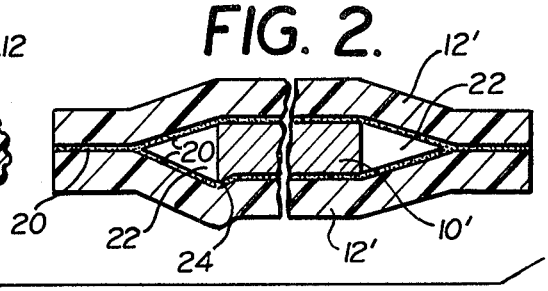

FIG. 2, which is on a somewhat larger scale than FIG. 1, shows an aluminum strip 10' with strips of polyester dielectric 12' bonded to the upper and lower surfaces of the aluminum strip 10' by adhesive 20.

The polyester strips 12' extend beyond the opposite edges of the aluminum strip 12' and the extending edges of the polyester strips are bonded together by the adhesive 20 which is also used to bond the polyester to the metal strip.

The type of shield shown in FIG. 2 has two distinct disadvantages. At the edges of the metal strip 10', where the polyester strips 12' are brought together for sealing, air gaps 22 are formed. These gaps 22 are a source of longitudinal water or gas flow in the finished cables. Such flow is highly undesirable since water ingress will corrode the internal aluminum shield 10', and gas flow is difficult to stop when pressure dams are constructed. These gaps 22 also allowed for the influx of the cable filling compound, which has a tendency to delaminate this variety of internal sealed construction.

The size of the gaps 22 is directly proportional to the thickness of the metal strip 10' and the dielectric used in the composite shield. The typical shield used is polyester strip of 0.003 inches in thickness; and the aluminum is 0.004 inches. These dimensions give rise to relatively large air gaps 22.

Figure 3:
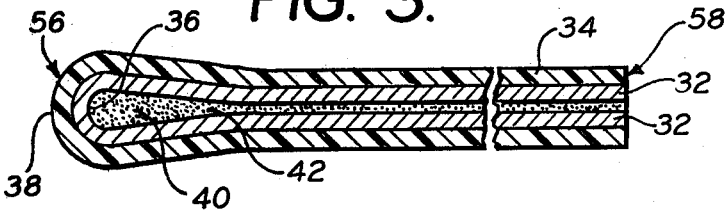
PRIOR ART FIG. 3.
FIG. 3 is an enlarged sectional view showing a shield construction made in accordance with this invention.

The construction shown in FIG. 2 with the adhesive edge seals, also exhibits poor dielectric strength at the metal tape 3 edges. This results from the fact that the adhesive 20 is electrically weak and voltage tracks through the adhesive edge seals. Another problem is that the aluminum strip 10' is generally made by slitting of a wider aluminum strip and the slitting operation leaves the strip 10' with a "knife-edge" electrode 24. There is a 0.5 probability that this "knife-edge" electrode will be toward the internally shielded unit, when the tape is applied at cabling. If such is the case, a preferential voltage breakdown, or edge condition, can occur between the "knife-edge" electrode and an insulated conductor, even through the dielectric 12'. FIG. 3 shows one construction of this invention. An aluminum strip 32 is coated on one side with dielectric coating material 34 which is bonded to the aluminum strip 32 by adhesive or by fusing the coating 34 to the aluminum strip 32. The strip 32 has a thickness of only one half the intended thickness of metal in the shield.

By folding the coated strip 32 along its longitudinal center line 36, the shield is made one half as wide as the unfolded metal strip 32 and the thickness of metal is doubled by the lower layer of the strip 32, as clearly shown at the right hand edge of FIG. 3.

A rounded edge 38 is formed at the left side of the shield and there is some space 40 within the folded edge. This space can be filled with adhesive such as polyurethane or other adhesive. This filling material, indicated by the reference character 42, is shown in FIG. 3 as coating the entire areas of the faces of the strip 32 which confront one another at opposite sides of the fold.

In FIG. 3, both the radius of the fold and the clearance between the confronting faces of the metal are exaggerated for clearer illustration. Actually the folds can be quite flat and the metal surfaces which face one another can be originally pressed together so as to displace the adhesive material 42 from regions of the confronting metal surfaces.

The tape shown in FIG. 3 has advantages over the tape shown in FIG. 2 in that it has a folded edge which eliminates the dielectrically weak adhesive seal of the FIG. 2 tape; and in addition the gaps 22 of FIG. 2 are eliminated in FIG. 3. The confronting faces of the folded aluminum strip 32, in FIG. 3, are secured together by polyurethane adhesive 42.

Figure 4:
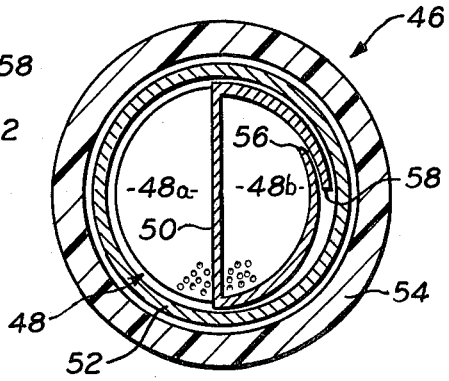
FIG. 4 is a sectional view showing the manner in which the shield of FIG. 3 is used in a cable as a D-Screen shield.

FIG. 4 is a diagrammatic view of a communication cable 46 comprising a core 48 made of two separate portions **48*a* and 48*b*, each of which includes one half of the pairs of conductors in the cable, each half carrying messages in opposite directions. The core half 48*b* is surrounded by a D-Screen 50 made of the folded tape shown in FIG. 3. Because of the small scale of FIG. 4,** no attempt is made to show the laminations of the shield.

The core 48 is surrounded by an overall shield 52 which surrounds the entire core 48 outside of the D-Screen 50. The overall screen 52 may be corrugated and it is covered by a plastic jacket 54.

The screen 50 is wide enough to enclose the entire core half **48*b* with a lap seam along the circumferential portion of the D-Screen 50.**

The D-Screen 50 has its protected edge 56, which is the folded edge of the construction shown in FIG. 3, on the inside of the lap seam; that is, the side toward the core half **48*b***.

The D-Screen 50 has its unprotected edge 58, the right hand edge of the construction shown in FIG. 3, located on the outside of the lap seam of the D-Screen. Since the unprotected edge 58 is directed away from paired working circuits, an increase in distance guarantees high voltage breakdown levels between the exposed (unprotected) aluminum tape edge and the cable core half **48*b*** containing the pairs that constitute the shielded circuits.

The tape of FIGS. 3 and 4, with its single fold, is referred to as the "U" fold tape. Because of the folding of the composite material at the protected edge, a slight increase in overall thickness occurs at this folded edge. When packing this "U" fold tape, this edge buildup results in a non-self supporting pad which has a tendency to fall over to one side, rendering the pad unusable. This can be corrected by the use of an oscillating takeup mechanism. Such a mechanism staggers the edge buildup and results in a good package capable of being used by the cable manufacturer.

Figure 5:
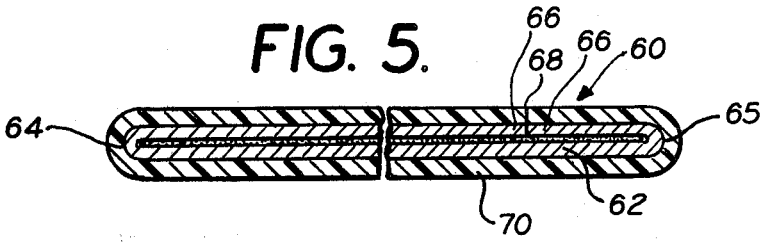
FIG. 5 is a sectional view, similar to FIG. 3, but showing a modified form of the invention.

FIG. 5 shows another construction in which a shield is formed from a tape 60 having an aluminum strip 62 which is folded along two parallel lines; these fold lines being indicated by the reference characters 64 and 65 in FIG. 5. The aluminum strip 62 has longitudinal edges 66 which are brought together at a butt seam 68. A dielectric coating 70, of polyester or other insulating material, is adhered to the outside of the aluminum strip 62 and has its edges also brought together at the butt seam 68. It is not essential that the edges of the aluminum strip 62 and the insulation 70 abut with one another, as shown in FIG. 5, but a better shield is formed if there is substantially no gap at the seam 68.

In the composite tape shown in FIG. 5, the confronting faces of the aluminum strip 62 can be secured together by polyurethane adhesive, as in FIG. 3 and any clearance at the folds can be filled with the polyurethane, or acrylic acid copolymer of polyethylene, or other compatible adhesive as already described in connection with FIG. 3. The tape of FIG. 5 has both edges protected and if there is extra thickness along the folds, this thickness occurs at both edges of the tape and thus does not cause any unsymmetrical winding of the tape when packaging.

Figure 6:
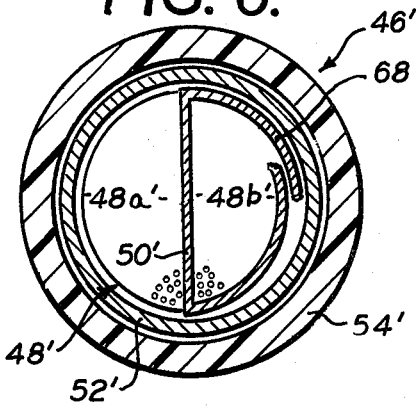
FIG. 6 is a view similar to FIG. 1 but showing the way in which the shield of FIG. 5 is used when employed as a D-Screen in a communication cable.

FIG. 6 is a diagrammatic view of a communication cable having a D-Screen 50' which is made from the tape of FIG. 5. Otherwise the cable shown in FIG. 6 is the same as that shown in FIG. 4 and corresponding parts are indicated by the same reference characters with a prime appended. As in FIG. 4, the D-Screen 50' of FIG. 6 is made with a lap seam and the D-Screen is formed so that the butt seam 68 of the tape 60 is located on the outside of the D-Screen 50'. Thus the core half **48*b*' is fully shielded without any interruption in the dielectric strength of the coating on the side of the shield that faces the pairs enclosed in the core half 48*b*'. In selecting the lines 64 and 65 (FIG. 5) for bending the aluminum strip, the lines are selected with one closer to the edge of the strip than the other so that the butt seam 68 is located near one edge of the composite shield 60. This locates the butt seam 68 on a portion of the D-Screen that faces toward the overall grounded shield 52'**.

It is desirable to have the opposite edges of the aluminum 62 and insulation 70 in actual contact at the butt seam 68; but a slight gap up to 1/16th inch may be tolerated. Additional protection from voltage breakdown, due to widths at the gap 68, can be obtained by the application of a polyester or other insulating tape over the gap; but the construction addition is costly and would result in an unbalanced package.

The tape construction shown in FIGS. 5 and 6 is referred to as the "offset O" fold tape. Additional sparkover voltage protection results from the filling compound in communication cables which are filled, because of the 500 volt per mil voltage breakdown strength offered by the filling compound. In air filled cables there is a noticable depreciation of voltage breakdown strength, with respect to the filled variety; though it still possesses breakdown limits in excess of those tapes presently used. The present trend is toward filled cables and, therefore, the "offset O" tape represents an excellent solution to the internally shielded PCM telephone cable.

In addition to the resultant higher voltage breakdown levels attainable with this tape, the two layers of aluminum tape, i.e. 2 × 0.002 inches, result in an improved shielding. In a solid 0.004 inch thickness of aluminum the incoming electromagnetic wave strikes the one surface of the aluminum where it is partially reflected. The wave is then attenuated by the shield metal as it travels through to the other surface, where it is again partially reflected, much as light is reflected through a lens. Where the aluminum is 0.0004 inches in thickness, but formed from two 0.002 inch layers of aluminum, which have been bonded, as with this invention, additional reflections occur at the adhesive interface. These additional reflections result in an effective improvement of attenuation of the electromagnetic waves, and, therefore, more effective shielding.

The preferred embodiments of this invention have been illustrated and described, but changes and modifications can be made and some features can be used in different combinations without departing from the invention as defined in the claims.

What is claimed is:

1. A strip for a telephone cable shield including a metal strip coated on one side with dielectric coating material and folded back on itself to form a shield having edges formed by the folds and having two layers of metal across most of its width of the shield and with two layers of dielectric coating, one on the upper and the other on the lower side of the shield, said coating extending around the folds of the metal, the original edges of the strip being at different distances from the folded edges.

2. The strip for a telephone cable shield as described in claim 1 characterized by adhesive filling material filling any space between the metal layers at the bend in the metal strip and elsewhere between parallel opposing faces of the layers of metal.

3. The strip for a telephone cable shield as described in claim 1 characterized by the metal strip having both of its edges folded back over the same surface of the strip so that there are reverse bends of metal along both edges of the shield, the edges of the strip being adjacent to one another.

4. The strip for a telephone cable shield as described in claim 1 and characterized by the edges of the strip being within about 1/16th of an inch of one another.

5. The strip for a telephone cable shield as described in claim 4 characterized by the edges of the strip being parallel with one another and in abutting relation with one another.

6. The strip for a telephone cable shield as described in claim 1 characterized by the strip being a cable screen bent along longitudinally extending regions with a mid-region substantially flat and with the portions of the screen at the upper and lower limits of the mid-region bent into curved contour toward the same side of the mid-region to form a semi-cylindrical portion of the screen with the opposite edges of the screen overlapping one another along a longitudinal seam of the bent screen.

7. The strip for a telephone cable shield as described in claim 6 characterized by the original edges of metal strip being on the edge of the screen that is on the outside surface of the edge portion of the strip that has the other edge portion of the strip overlap it on the outside of the screen at the lapped edges of the screen seam.

8. The strip for a telephone cable shield as described in claim 6 characterized by the metal strip having both of its edge portions folded back on the strip so that there are reverse bends of the metal along both edges of the screen, the edges of the strip being on the same side of the screen and adjacent to one another and on the side of the screen that faces away from the center of curvature of the curved portion of the screen.

9. The strip for a telephone cable shield as described in claim 6 characterized by the screen being part of the core of a telephone cable and enclosing substantially half of the pairs of conductors of said core.

10. The strip for a telephone cable shield as described in claim 9 characterized by an outer metal shield enclosing pairs of conductors that transmit messages in both directions, the pairs that transmit in one direction being enclosed within the screen having the folded metal strip and the outer shield enclosing the pairs that transmit in the other direction and also enclosing the screen formed from the folded metal strip.

11. The strip for a telephone cable shield as described in claim 10 characterized by the semi-cylindrical portion of the inner screen being adjacent to the outer shield for capacitive effect, but spaced from the outer shield to prevent direct contact of the screen and shield, and the pairs within the inner screen being confined by direct contact with the inside surface of the inner screen.

12. The strip for a telephone cable shield as described in claim 9 characterized by the metal strip being a good electrical conductor, such as aluminum, and of a thickness of from 0.00035–0.005 inches whereby the folded strip provides the screen with a metal thickness of twice that of the strip, and the coating on the strip being of a thickness of from 0.001 to 0.004 inches.

13. The strip for a telephone cable shield as described in claim 12 characterized by the metal strip being of aluminum of a thickness of about 0.002 inches and the coating on the surface of each side of the metal of the shield being about 0.002 to 0.003 inches, and the sides of the metal that face one another in the folded strip being coated with adhesive filling material including polyethylene petroleum jelly.

14. A strip for a telephone cable shield including a metal strip coated on one side with dielectric coating material and folded at a mid-region of the metal strip to form a screen having two layers of metal folded substantially flat at one side of the strip and with two layers of dielectric coating, one on each side of the screen, said coating extending around the fold of the metal, and the original edges of the strip forming the edge of the screen on the side opposite the fold, the screen being bent along longitudinally extending regions with the portion of the screen between the longitudinal bends being substantially flat and the portions of the screen at the upper and lower limits of the mid-region being bent into curved contour toward the same side of the mid-region to form a semi-cylindrical portion of the screen with the opposite edges of the screen overlapping along a longitudinal seam, the screen enclosing a group of conductors of the telephone cable between the substantially flat region of the screen and the semi-cylindrical portion thereof, the original edge portions of the strip being on the outside of the lap seam remote from the pairs enclosed within the screen.

* * * * *